US010367257B2

(12) United States Patent
Lee

(10) Patent No.: US 10,367,257 B2
(45) Date of Patent: Jul. 30, 2019

(54) ANTENNA, VEHICLE HAVING THE ANTENNA, AND METHOD FOR CONTROLLING THE ANTENNA

(71) Applicant: HYUNDAI MOTOR COMPANY, Seoul (KR)

(72) Inventor: Sang Heun Lee, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 366 days.

(21) Appl. No.: 15/174,276

(22) Filed: Jun. 6, 2016

(65) Prior Publication Data

US 2017/0133753 A1 May 11, 2017

(30) Foreign Application Priority Data

Nov. 6, 2015 (KR) ..... 10-2015-0155569

(51) Int. Cl.
*H01Q 1/32* (2006.01)
*H01Q 13/06* (2006.01)
*H01Q 21/00* (2006.01)

(52) U.S. Cl.
CPC ..... *H01Q 1/3283* (2013.01); *H01Q 1/3233* (2013.01); *H01Q 13/06* (2013.01); *H01Q 21/0037* (2013.01)

(58) Field of Classification Search
CPC .... H01Q 1/3283; H01Q 1/3233; H01Q 13/06; H01Q 21/0037
USPC ..... 343/713, 872, 789
See application file for complete search history.

(56) References Cited

U.S. PATENT DOCUMENTS

2002/0044099 A1* 4/2002 Yamamoto ..... H01Q 1/007 343/789
2009/0121956 A1* 5/2009 Koshiji ..... H01Q 9/285 343/794
2011/0199282 A1* 8/2011 Oishi ..... H01Q 9/0407 343/872
2013/0271335 A1* 10/2013 Ryu ..... H01Q 13/02 343/786
2013/0335293 A1* 12/2013 Zhang ..... H01Q 3/242 343/876
2015/0309165 A1* 10/2015 Elwart ..... G01S 7/4026 342/61
2016/0218423 A1* 7/2016 Roulston ..... H01Q 13/18

FOREIGN PATENT DOCUMENTS

JP 2006-324916 A 11/2006
JP 5618270 B2 11/2014
KR 10-2005-0103608 A 11/2005
KR 10-0684469 B1 2/2007
KR 10-2010-0022759 A 3/2010
KR 10-1037294 B1 5/2011
KR 10-2011-0126939 A 11/2011

* cited by examiner

*Primary Examiner* — Peguy Jean Pierre
(74) *Attorney, Agent, or Firm* — Morgan, Lewis & Bockius LLP

(57) ABSTRACT

An antenna includes an opening through which a radio wave is radiated in an orientation direction, and a conductor inserted into the opening and dividing an internal region of the opening.

13 Claims, 25 Drawing Sheets

(a)

(b)

(a)

(b)

(a)

(b)

(a)

(b)

(c)

ANTENNA, VEHICLE HAVING THE ANTENNA, AND METHOD FOR CONTROLLING THE ANTENNA

CROSS-REFERENCE TO RELATED APPLICATION

This application claims the benefit of priority to Korean Patent Application No. 10-2015-0155569, filed on Nov. 6, 2015 with the Korean Intellectual Property Office, the disclosure of which is incorporated herein by reference.

TECHNICAL FIELD

Embodiments of the present disclosure relate to an antenna and a vehicle having the antenna.

BACKGROUND

A radar device is a device that emits a radar signal through an antenna, receives a signal reflected by an object within a corresponding region through the antenna, and thereby detects the presence or absence of the object, a distance between the radar device and the object, a direction, an altitude, and/or other variables.

Such a radar device is applied to a wide variety of fields in which the detection of an object is required. In particular, in a vehicular field, the radar device may be mounted on a vehicle and may be operated in conjunction with a variety of vehicle control systems using the object detection result. Thus, studies for the miniaturization of the radar device built into the vehicle are on-going.

SUMMARY

Therefore, it is an aspect of the present disclosure to provide an antenna and a vehicle having the same.

Additional aspects of the disclosure will be set forth in part in the description which follows and, in part, will be obvious from the description, or may be learned by practice of the disclosure.

In accordance with one aspect of the present disclosure, an antenna includes an opening through which a radio wave is radiated in an orientation direction; and a conductor that is inserted into the opening and divides an internal region of the opening.

Here, the conductor may be implemented in the form of a polygon, and divide an aperture through which the radio wave is radiated in the opening.

Also, the conductor may be formed in such a manner that a height of a plane in a direction in which the radio wave is input to the opening and a height of a plane in a direction in which the radio wave is radiated are different from each other.

Also, the conductor may be formed in such a manner that a height of a plane in a direction in which the radio wave is input to the opening is lower than a height of a plane in a direction in which the radio wave is radiated.

Also, the conductor may be implemented in the form of a straight line or a cross when an inside of the antenna is viewed with respect to the opening.

Also, the type of the conductor may be determined based on a wavelength of the radiated radio wave.

In accordance with another aspect of the present disclosure, a vehicle includes a radar device that detects an object present around the vehicle using an antenna in which a partition wall structure is formed by a polygonal conductor inserted into the antenna; and a controller that provides a detection result using the radar device by controlling a device inside the vehicle.

Here, the antenna in which the polygonal conductor is inserted into the antenna so as to divide an aperture through which a radio wave is radiated in the opening may be provided.

Also, the conductor may be formed in such a manner that a height of a plane in a direction in which the radio wave is input to the opening and a height of a plane in a direction in which the radio wave is radiated are different from each other, and the formed conductor may be inserted into the antenna.

Also, the conductor may be formed in such a manner that a height of a plane in a direction in which the radio wave is input to the opening is lower than a height of a plane in a direction in which the radio wave is radiated, and the formed conductor may be inserted into the antenna.

Also, the antenna may be implemented in the form of a straight line or a cross when an inside of the antenna is viewed with respect to the opening.

Also, the type of the conductor may be determined based on a wavelength of the radio wave radiated through the antenna, and the determined conductor may be inserted into the antenna.

Also, the controller may display the detection result from the radar device using at least one of a display and a cluster, or transmit the detection result from the radar device using a speaker.

In accordance with still another aspect of the present disclosure, a method of manufacturing an antenna includes calculating a gain of the antenna which is predicted according to a length and a height of the antenna; determining a shape and a size of a conductor by comparing the calculated gain of the antenna and a gain of the antenna which is predicted when a conductor for dividing an aperture of an opening of the antenna is inserted; and manufacturing the antenna by inserting a conductor generated based on the determined shape and size of the conductor into the antenna.

Here, the determining may include determining the size of the conductor in such a manner that a height of a plane in a direction in which a radio wave is input to the opening and a height of a plane in a direction in which the radio wave is radiated are different from each other.

Also, the determining may include determining the size of the conductor in such a manner that a height of a plane in a direction in which the radio wave is input to the opening is lower than a height of a plane in a direction in which the radio wave is radiated.

Also, the determining may include determining the shape of the conductor in the form of a straight line or a cross when an inside of the antenna is viewed with respect to the opening.

Also, the manufacturing may include inserting the conductor so as to be parallel to at least one of an E-plane parallel to a direction of an electric field vector and an H-plane parallel to a direction of a magnetic field vector.

In accordance with yet another aspect of the present disclosure, a method of controlling a vehicle includes detecting an object present around a vehicle using a radar device including an antenna in which a partition wall structure is formed by a polygonal conductor being inserted into the antenna; and providing a detection result through the radar device by controlling a device inside the vehicle.

Here, the providing may include displaying the detection result through the radar device using at least one of a display and a cluster, or transmitting the detection result through the radar device using a speaker.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, embodiments of the present disclosure will be described in detail with reference to the accompanying drawings.

Figure 1:
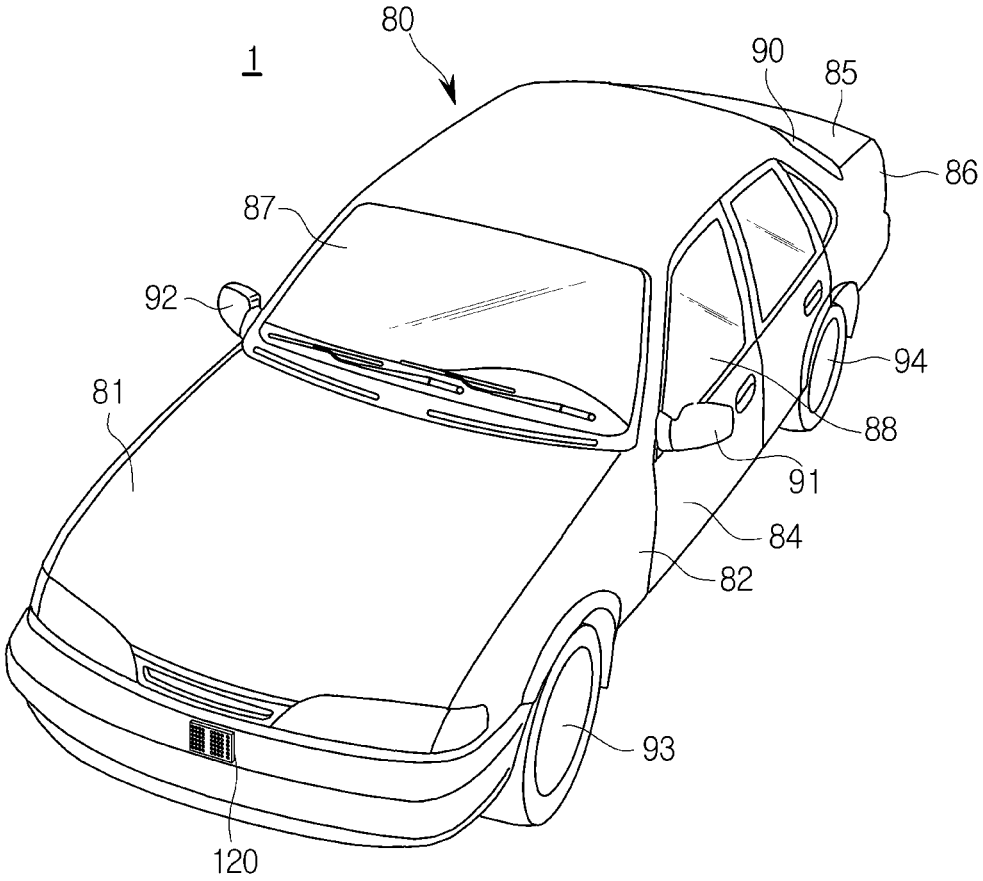
FIG. 1 is a view showing an external configuration of a vehicle in accordance with one embodiment of the present disclosure.
Figure 2:
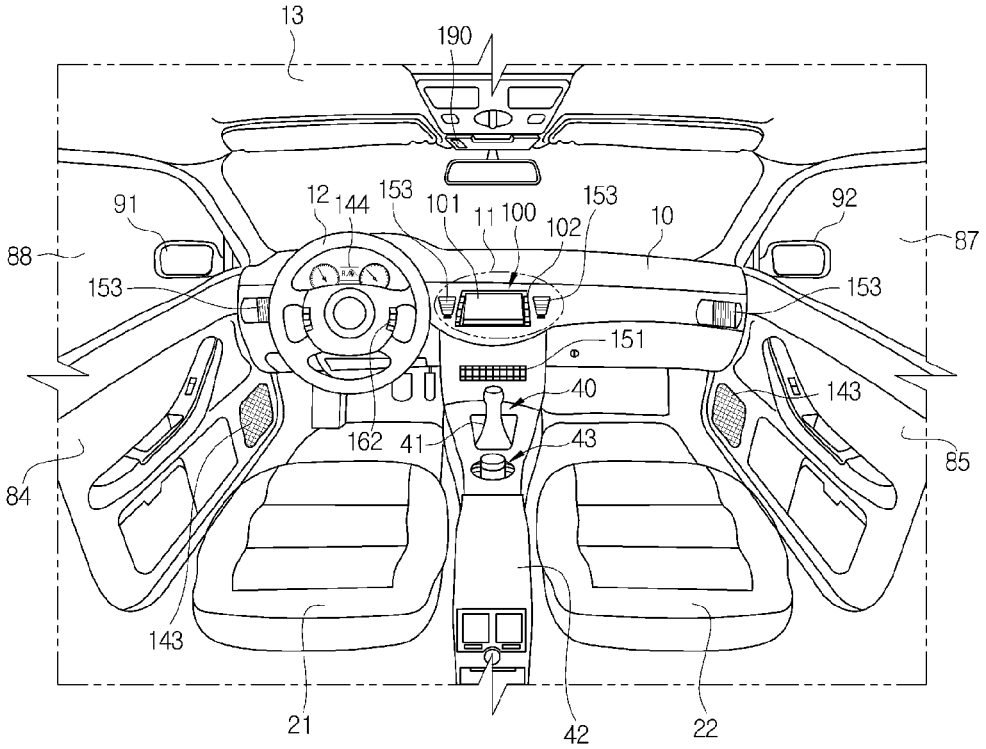
FIG. 2 shows an internal configuration of a vehicle in accordance with one embodiment of the present disclosure.
Figure 3:
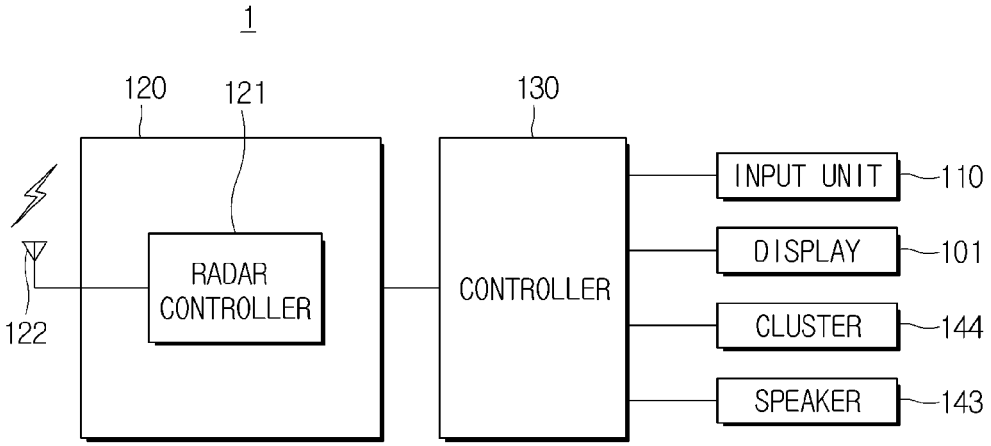
FIG. 3 is a control block diagram showing a radar device provided in a vehicle in accordance with one embodiment of the present disclosure.
Figure 4A:
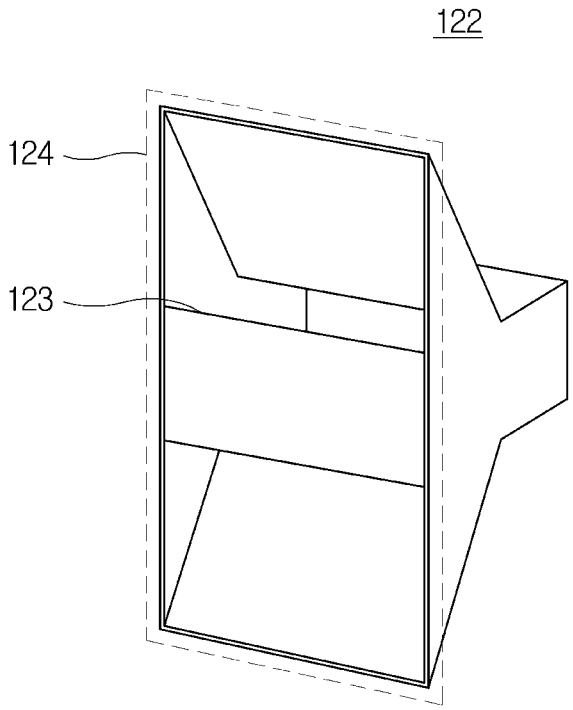
FIG. 4A shows a shape of an antenna viewed from a variety of angles, and sections, in accordance with one embodiment of the present disclosure.
Figure 4B:
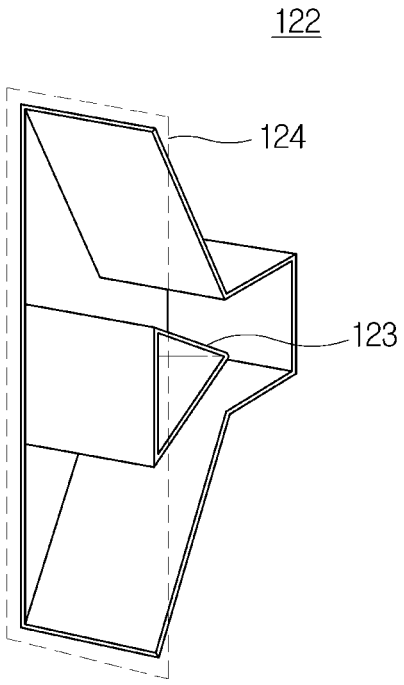
FIG. 4B shows a shape of an antenna viewed from a variety of angles, and sections, in accordance with one embodiment of the present disclosure.
Figure 5A:
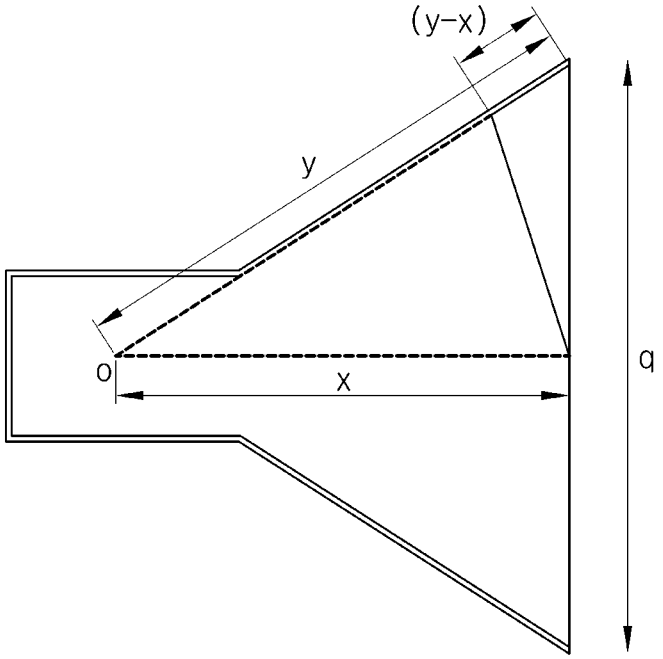
FIG. 5A is a view illustrating a principle in which insertion of a conductor increases a gain of an antenna in accordance with one embodiment of the present disclosure.
Figure 5B:
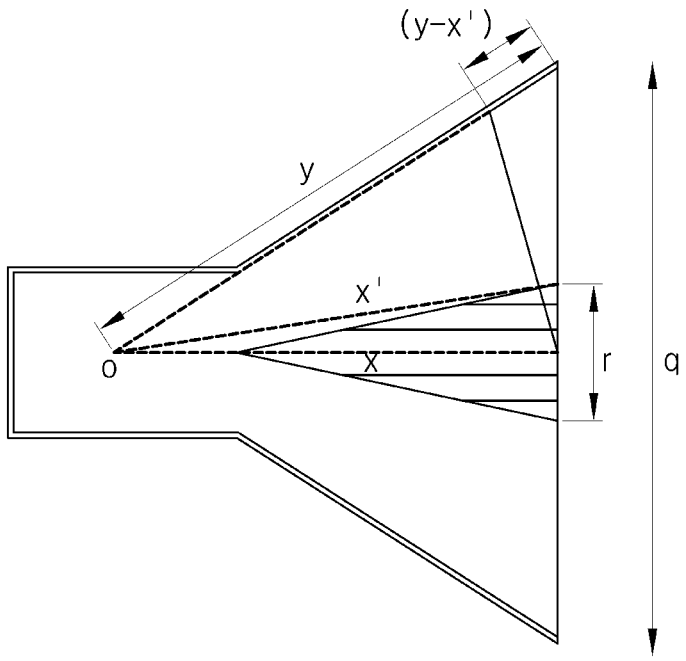
FIG. 5B is a view illustrating a principle in which insertion of a conductor increases a gain of an antenna in accordance with one embodiment of the present disclosure.
Figure 6A:
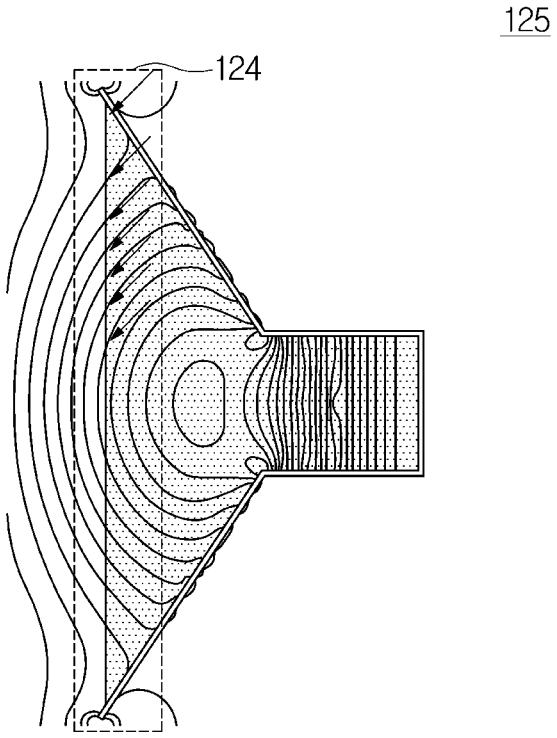
FIG. 6A shows a phase front in an aperture in accordance with one embodiment of the present disclosure.
Figure 6B:
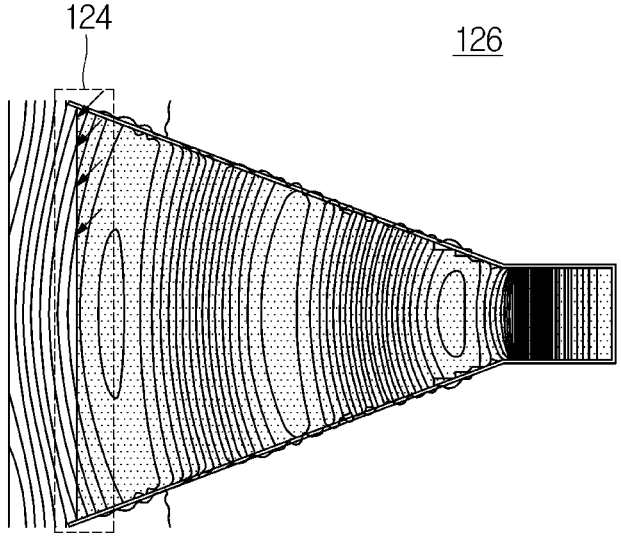
FIG. 6B shows a phase front in an aperture in accordance with one embodiment of the present disclosure.
Figure 6C:
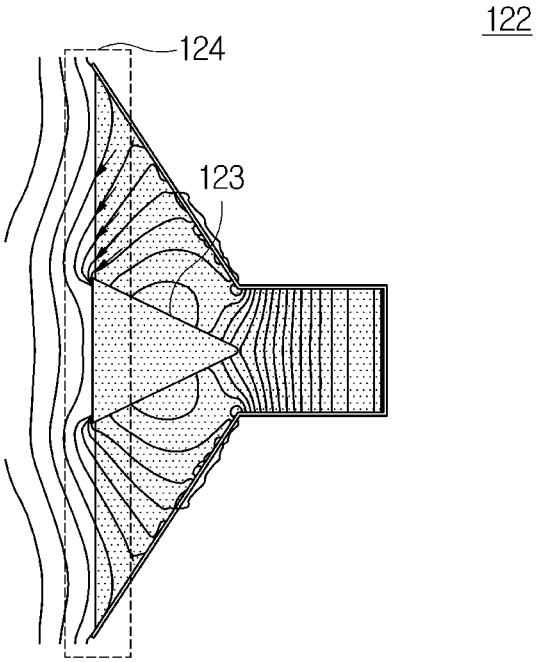
FIG. 6C shows a phase front in an aperture in accordance with one embodiment of the present disclosure.
Figure 7A:
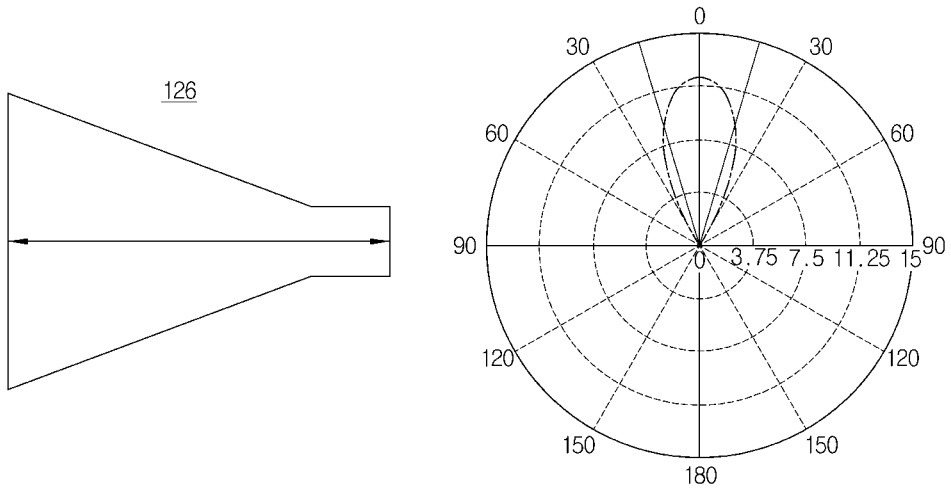
FIG. 7A is a view illustrating a gain of an antenna depending on a length of the antenna and whether a conductor is inserted into the antenna in accordance with one embodiment of the present disclosure.
Figure 7A:
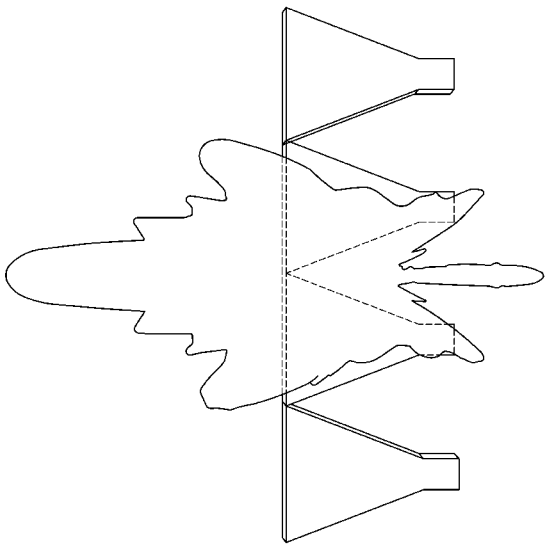
Figure 7B:
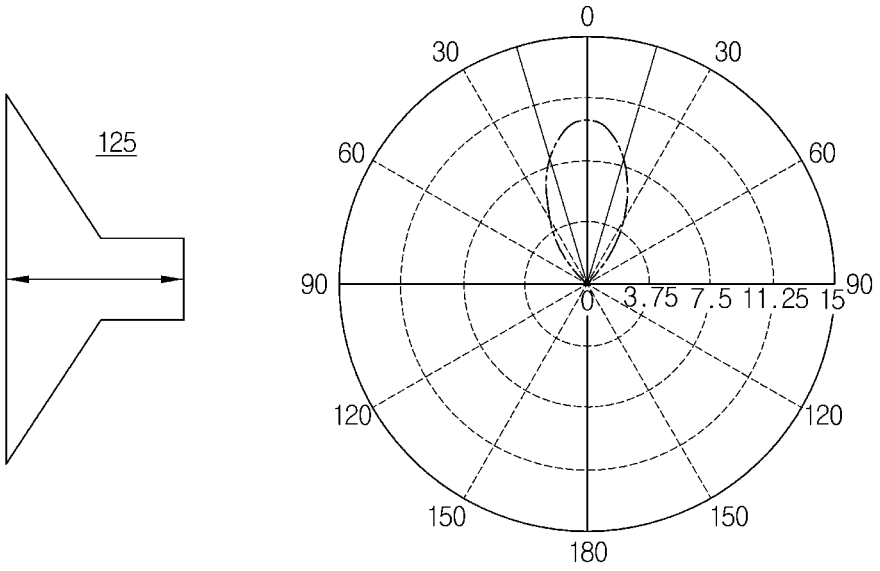
FIG. 7B is a view illustrating a gain of an antenna depending on a length of the antenna and whether a conductor is inserted into the antenna in accordance with one embodiment of the present disclosure.
Figure 7B:
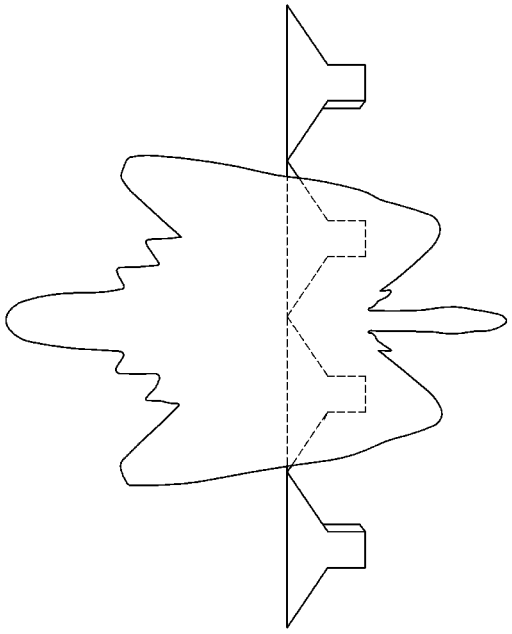
Figure 7C:
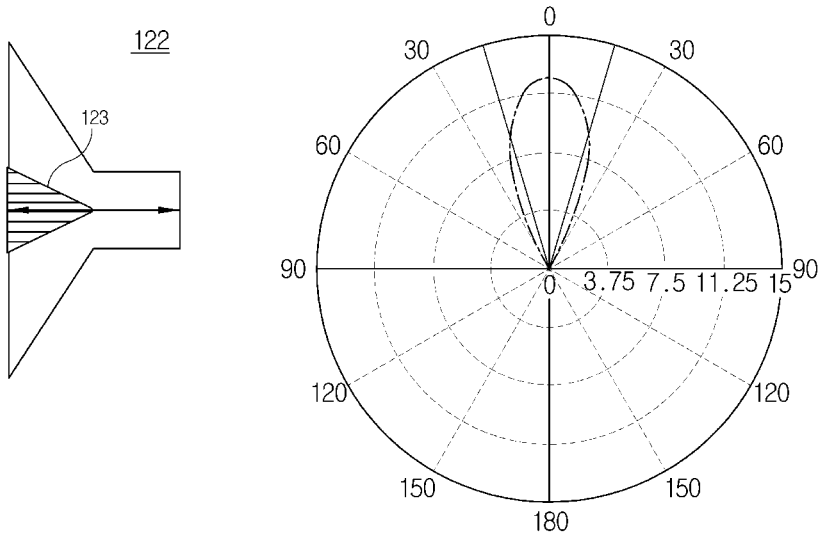
FIG. 7C is a view illustrating a gain of an antenna depending on a length of the antenna and whether a conductor is inserted into the antenna in accordance with one embodiment of the present disclosure.
Figure 7C:
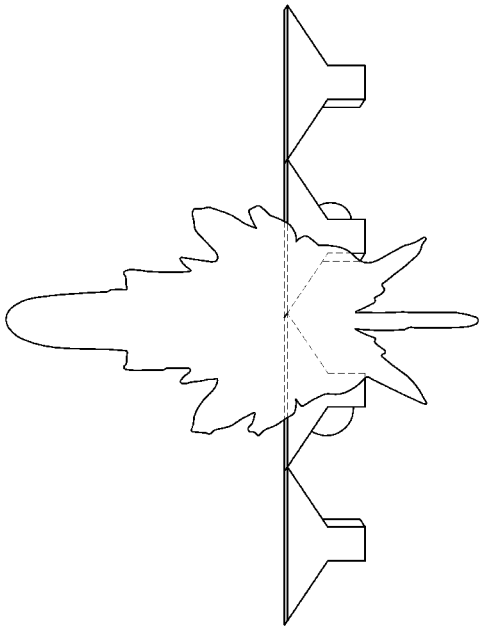

FIG. 1 is a view showing an external configuration of a vehicle in accordance with one embodiment of the present disclosure, FIG. 2 shows an internal configuration of a vehicle in accordance with one embodiment of the present disclosure, FIG. 3 is a control block diagram showing a radar device provided in a vehicle in accordance with one embodiment of the present disclosure, FIGS. 4A and 4B show a shape of an antenna viewed from a variety of angles, and sections, in accordance with one embodiment of the present disclosure, FIGS. 5A and 5B are views illustrating a principle in which insertion of a conductor increases a gain of an antenna in accordance with one embodiment of the present disclosure, FIGS. 6A to 6C show a phase front in an aperture in accordance with one embodiment of the present disclosure, and FIGS. 7A to 7C are views explaining a gain of an antenna depending on a length of the antenna and whether a conductor is inserted into the antenna in accordance with one embodiment of the present disclosure. Hereinafter, like reference numerals refer to like elements.

Referring to FIG. 1, a vehicle 1 may include a vehicle body 80 that forms an appearance of the vehicle 1, and vehicle wheels 93 and 94 that move the vehicle 1. The vehicle body 80 includes a hood 81, a front fender 82, a door 84, a trunk lid 85, a quarter panel 86, and the like.

In addition, a front window 87 is provided at a front side of the vehicle body 80 and provides a field of view in front of the vehicle 1, a side window 88 provides a field of view toward a side of the vehicle 1, side mirrors 91 and 92 that are provided in the door 84 provide a field of view behind the vehicle 1 and a field of view toward the side of the vehicle 1, and a rear window 90 provided at a rear side of the vehicle body 80 and provides a field of view behind the vehicle 1 may be provided on or outside the vehicle body 80. Hereinafter, the internal configuration of the vehicle 1 will be described in more detail.

An air conditioner may be provided in the vehicle 1. The air conditioner, which will be described below, refers to a device that automatically controls an air conditioned environment including indoor/outdoor environmental conditions of the vehicle 1, air intake/exhaust, circulation, heating/cooling conditions, and the like, or controls the air conditioned environment in response to a user's control command. For example, the air conditioner may be provided in the vehicle 1 to perform both heating and cooling, and to control a temperature inside the vehicle 1 by discharging heated or cooled air through an air vent 153.

Meanwhile, an audio video navigation (AVN) terminal 100 may be provided inside the vehicle 1. The AVN terminal 100 refers to a terminal that is able to collectively provide audio and video functions, as well as a navigation function which provides a route to a destination to a driver. Here, the AVN terminal 100 may be referred to as a navigation terminal, and referred to by other terminology commonly used to those skilled in the art.

The AVN terminal 100 may selectively display one or more screens of an audio screen, a video screen, and a navigation screen through a display 101, and also display a variety of control screens associated with a control of the vehicle 1 or a screen associated with additional functions which may be executed in the AVN terminal 100.

According to one embodiment, the AVN terminal 100 may display a variety of control screens associated with a control of the air conditioner using the display 101, in conjunction with the above-described air conditioner. In addition, the AVN terminal 100 may adjust the air conditioned environment inside the vehicle by controlling an operational state of the air conditioner. In addition, the AVN terminal 100 may display a map with a route to a destination displayed thereon using the display 101.

Meanwhile, the display 101 may be located at a center fascia 11 which is a central region of a dashboard 10. According to one embodiment, the display 101 may be implemented as a liquid crystal display (LCD), a light emitting diode (LED) display, a plasma display panel (PDP), an organic light emitting diode (OLED) display, a cathode ray tube (CRT) or the like, but is not limited thereto.

A speaker 143 that is able to output sound may be provided inside the vehicle 1. Accordingly, the vehicle 1 may output sound required for performing the audio function, the video function, the navigation function, and other additional functions using the speaker 143. For example, the vehicle 1 may provide the route to the destination to the driver using the speaker 143.

A navigation input unit 102 may be located at the center fascia 11 which may be a central region of the dashboard 10. The driver may input a variety of control commands by manipulating the navigation input unit 102, and input a destination, and the like.

Meanwhile, the navigation input unit 102 may be provided with a hard key type in a region adjacent to the display 101, and when the display 101 is implemented in a touch screen type, the display 101 may also perform the function of the navigation input unit 102.

Meanwhile, a center input unit 43 of a jog shuttle type or a hard key type may be provided in a center console 40. The center console 40 is located between a driver seat 21 and a passenger seat 22 and includes a gear shift lever 41 and a tray 42 formed therein. The center input unit 43 may perform all or some functions of the navigation input unit 102.

Meanwhile, a voice input unit 190 may be provided inside the vehicle 1. The voice input unit 190 may receive a voice command of a user. For example, the voice input unit 190 may be implemented as a microphone. The voice input unit 190 may receive a voice command spoken by the driver using a microphone and convert the received voice command into an electrical signal.

According to one embodiment, the voice input unit 190 may be mounted in a head lining 13 as shown in FIG. 2, but the location of the voice input unit 190 is not limited thereto. For example, the voice input unit 190 may be mounted on the dashboard 10 or a steering wheel 12. In addition, any location of the voice input unit 190 is possible as long as it suitably receives a voice of the driver.

In addition, a cluster 144 may be provided inside the vehicle 1. The cluster 144 is also referred to as a dashboard, but hereinafter, for convenience of description, it may be referred to as the cluster 144. A traveling speed of the vehicle, an engine revolutions per minute (RPM), a fuel quantity, and the like may be displayed on the cluster 144. In addition, a traveling route may be displayed on the cluster 144 in conjunction with the AVN terminal 100, and environmental information such as speed limit information and the like may be also displayed. In addition, the detection result obtained by detecting the surroundings of the vehicle 1 may be displayed on the cluster 144. This will be described in detail later.

In addition, referring to FIG. 3, the vehicle 1 may further include an input unit 110, a radar device 120 and a controller 130 in addition to the above-described components.

The input unit 110 may be implemented by the above-described navigation input unit 102, voice input unit 190 and/or center input unit 43. When the display 101 is implemented in the touch screen type, the display 101 may perform the function of the input unit 110.

The input unit 110 may receive a variety of control commands from the driver or passengers (hereinafter, all of the passengers may be referred to as a user). For example, the input unit 110 may additionally receive execution commands of various modules built into the AVN terminal 100 in addition to a variety of execution commands of devices inside the vehicle 1 such as a detection command for the surroundings of the vehicle 1 using the radar device 120.

Meanwhile, the radar device 120 may include a radar controller 121 and an antenna 122. The radar device 120 may be provided in a front surface of the vehicle as shown in FIG. 1, but the location of the radar device 120 is not limited thereto.

The radar controller 121 may control the overall operations of the radar device 120. In response to a control signal received from the controller 130, the radar controller 121 may control the transmission/reception of a radar signal through the antenna 122. Hereinafter, for convenience of description, the radar signal is referred to as a radio wave.

The radar controller 121 may include a processing device, or the like, that is able to perform a variety of operations and control processes involving processors built into the radar device 120, and may include a variety of known processing devices.

In addition, in the radar controller 121, a transceiver for transmitting/receiving a radio wave, a signal processor for performing a signal process of the radio wave, and the like may be integrated. For example, the transceiver may include a variety of elements required for transmitting/receiving a radio wave such as an oscillator, an amplifier, a filter and an analog/digital (A/D) converter, etc. That is, the radar controller 121 may be implemented by a variety of devices that support the transmission/reception of a radio wave and conversion between a radio wave and a digital signal, in addition to the above-described processor.

The radar controller 121 may radiate radio waves of various frequencies using the antenna 122. In general, the radar controller 121 used in the vehicle may use tens of GHz bands. For example, the radar controller 121 may radiate radio waves of 24 GHz, 76 to 79 GHz, or 94 GHz, but the present disclosure is not limited thereto.

Meanwhile, the antenna 122 is capable of transmitting a radio wave and is also capable of receiving a radio wave reflected from an object. Here, the object includes all of various objects that are able to reflect a radio wave. According to an embodiment, the object includes all of various objects present on the road or on a periphery of the road such as road signs, notices, and the like, which are present around the vehicle 1 as well humans, animals and plants.

The antenna 122 may be implemented in various forms. Here, the antenna 122 includes various types of antennas such as a horn antenna implemented in a trumpet-shape, a horn antenna whose side surface is implemented in a conical shape such as a pyramid, a circular horn antenna, and the like. Hereinafter, a horn antenna will be described as one example of the types of the antenna 122, but the antenna 122 according to an embodiment is not limited only to the horn antenna.

As shown in FIG. 4A, a trumpet-shaped opening may be provided in the antenna 122 and radiate a radio wave received through a waveguide to an external space. In this instance, a plane through which the radio wave is radiated is referred to as an aperture 124.

A conductor 123 may be inserted into an opening so that the aperture 124 of the antenna 122 may be divided into two areas as shown in FIGS. 4A and 4B. Accordingly, a partition wall structure may refer to a structure in which a specific area is divided by a partition wall. That is, the inside of the antenna 122 has the partition wall structure by the above-described conductor 123. In other words, the conductor 123 corresponds to a partition wall dividing the inside of the antenna 122. Accordingly, the radio wave may be radiated through the partitioned aperture 124.

Referring to FIGS. 4A and 4B, the conductor 123 may be attached to one side surface of the opening. The conductor 123 may be attached by a variety of known materials, and also may be designed and produced in such a manner as to be attached to one surface of the opening in the initial design.

Meanwhile, the conductor 123 may be made of the same or similar material as that of the antenna 122. The material constituting the antenna 122 and the conductor 123 may be implemented by a variety of already known materials.

Meanwhile, the conductor 123 may be implemented in a triangular shape when viewed from one side as shown in FIG. 4B, alternatively, it may be implemented in a variety of polygonal shapes. Descriptions of specific embodiments of this type will be made later.

Here, an inclined plane of the conductor 123 and an inclined plane of the antenna 122 may be formed at the same angle, and may be formed at different angles as shown in FIG. 4B.

The antenna 122 according to the disclosed embodiment may reduce a phase difference between radiated radio waves using the conductor 123 inserted into the opening. Accordingly, the antenna 122 may increase a gain in an orientation direction. In other words, the antenna 122 according to the embodiment has a partition wall structure by the conductor 123, and thereby it may be possible to increase the gain of the radio wave radiated to the aperture.

The gain of the antenna 122 refers to a range of a radio wave radiated in the orientation direction, that is, the target direction. Accordingly, when the gain of the antenna 122 is increased, although using the same output, a detectable range in a specific direction is increased.

In this instance, the gain of the antenna 122 may be determined depending on a phase difference between radio waves distributed in the aperture 124 and an area of the aperture 124. For example, the gain of the antenna 122 may be increased along with an increase in the area of the aperture 124, that is, an increase in the area of the plane through which the radio wave is radiated. In addition, the gain of the antenna 122 may be increased along with a reduction in the phase difference between the radio waves in the aperture 124. In general, when a length of the antenna 122 is increased, a path difference between a radio wave propagating from a phase center to a center of the aperture 124 and a radio wave propagating from the phase center to an edge of the aperture 124 is reduced, and therefore the phase difference between the radio waves in the aperture 124 is also reduced.

That is, the gain of the antenna 122 may be increased along with an increase in the length of the antenna 122. However, the antenna 122 becomes larger along with an increase in the area of the aperture 124 and with an increase in the length of the antenna 122, so that it may not be appropriate for being built into a device, and manufacturing costs are increased. Thus, as to the antenna 122 according to the disclosed embodiment, the conductor 123 may be provided in an area in which a radio wave is radiated, that is, the aperture, so that it is possible to increase the gain of the antenna 122 by reducing the phase difference between the radio waves in the aperture 124 even though the length of the antenna is not increased. Hereinafter, a cause of the increase in the gain of the antenna 122 due to the conductor 123 will be described in detail.

FIG. 5A shows a cross-section of an antenna in which a conductor is not inserted. Referring to FIG. 5A, x denotes a path of a radio wave radiated to a central area of the aperture with respect to a phase center O, and y denotes a path of a radio wave radiated to the edge of the aperture. That is, x corresponds to the shortest path among radiation paths of the radio waves and y corresponds to the longest path among the radiation paths of the radio waves. Thus, the maximum phase difference between the radio waves is y-x.

Meanwhile, FIG. 5B shows a cross-section of a partition wall structure of an antenna. Here, the path of the radio wave radiated to the edge with respect to the phase center is y, which is the same as in FIG. 5A. However, the conductor is inserted into the opening, so that the shortest radiation path of the radio wave is x'. Accordingly, a maximum phase error of the antenna according to the disclosed embodiment becomes smaller. Thus, the antenna according to the disclosed embodiment may provide a higher gain by reducing the phase difference between the radio waves in the aperture even with the same length of the antenna.

FIG. 6A shows a phase front of a radio wave radiated through an antenna having a short length, FIG. 6B shows a phase front of a radio wave radiated through an antenna having a long length, and FIG. 6C shows a phase front of a radio wave radiated through an antenna having a partition wall structure.

As shown in FIG. 6A, when a length of an antenna 125 is short, since an area in which a radio wave is able to radiate rapidly increases, the phase difference between the radio waves in the aperture 124 is increased. Conversely, as shown in FIG. 6B, when the length of an antenna 126 is long, since the area in which the radio wave is able to radiate gradually increases, it may be confirmed that the phase difference between the radio waves in the aperture 124 becomes smaller than that in the antenna 125 of FIG. 6A. However, the antenna 126 shown in FIG. 6B is difficult to build into a device due to the increase in size of the antenna, resulting in an increase in manufacturing costs.

The length of the antenna 122 shown in FIG. 6C is the same as that of the antenna 125 shown in FIG. 6A. In this instance, referring to the phase front, as to the antenna 122 shown in FIG. 6C, the phase difference becomes smaller than that in the antenna 125 shown in FIG. 6A as the conductor 123 is inserted into the antenna.

More specifically, the length of the antenna 126 shown in FIG. 7A is longer than that of the antenna 125 shown in FIG. 7B. The gain of the antenna 126 shown in FIG. 7A is 11.8 dBi, and the gain of the antenna 125 shown in FIG. 7B is 9.9 dBi, so that it may be confirmed that the gain is increased along with an increase in the length of the antenna.

The antenna 122 according to the embodiment shown in FIG. 7C may form a partition wall structure by the conductor 123 being inserted, and formed to have the same length as that of the antenna 125 shown in FIG. 7B. In this instance, the gain of the antenna 122 shown in FIG. 7C is 12.2 dBi, so that the antenna 122 has a gain higher than that of the antenna 125 having the same length.

In addition, cases in which a plurality of antennas is arranged and radio waves are radiated will be compared. Based on a comparison between radiation characteristics shown in FIG. 7C and radiation characteristics shown in FIG. 7B, it may be confirmed that the antenna 122 in which the conductor 123 of FIG. 7C is inserted has a stronger intensity of the radio wave radiated to a main lobe than that in the antenna 125 of FIG. 7B, and has weaker intensity than the radio wave radiated to a side lobe than that in the antenna 125 of FIG. 7B.

The antenna 122 according to the disclosed embodiment may be miniaturized and the manufacturing costs thereof may be reduced. In addition, when a plurality of antennas 122 according to the disclosed embodiment is arranged, the antennas designed in the same form may be arranged. Accordingly, the plurality of antennas 122 is arranged so that a disadvantage of having to individually design respective antennas may be avoided.

However, as described above, the gain of the antenna 122 may be determined depending on the size of the aperture in addition to the phase difference. When the conductor 123 is inserted into the antenna, the size of the aperture of the antenna is reduced. In addition, as a height of a plane in a direction in which the radio wave is radiated becomes higher, the size of the aperture of the antenna 122 is further reduced, so that the gain is reduced.

For example, referring to FIG. 5B, q corresponds to the height of the aperture, and r denotes the height of a plane in which no radio wave is radiated due to the inserted conductor. Accordingly, the height of the plane in which the radio wave is radiated may be reduced to q-r.

Thus, as to the antenna 122 according to the disclosed embodiment, a conductor implemented to have an appropriate size and appropriate shape may be inserted into the antenna, thereby increasing the gain of the antenna 122 while reducing the length of the antenna 122. Hereinafter, this will be described in more detail below.

Meanwhile, the controller 130 may be provided inside the vehicle 1. The controller 130 may be implemented by a processing device, or the like, that performs a variety of operations and control processes, such as a processor built into the AVN terminal 100, and implemented by a variety of known processing devices.

The controller 130 may control the overall operations of the vehicle 1. Specifically, the controller 130 may control the operations of all components provided in the vehicle 1 such as the display 101, the speaker 143, the cluster 144, and the like, in addition to a variety of modules such as a voice recognition module built in the AVN terminal 100. The controller 130 may control the operations of the above-described components by generating control signals for controlling the components of the vehicle 1.

For example, the controller 130 may control the operation of the air conditioner through the control signal, and may display a variety of information by controlling the operation of the display 101. In addition, the controller 130 may control a variety of display devices such as the display 101 through the control signal, or provide a variety of information to a user by controlling the speaker 143.

According to one embodiment, the controller 130 may control the operation of the radar device 120 by generating a control signal in response to a detection command received from the user using the input unit 110. Accordingly, the controller 130 may provide the detection result of an object present around the vehicle 1 using the radar device 120.

For example, the controller 130 may control the display device capable of displaying a variety of information such as the display or the cluster, thereby displaying the detection result. In addition, the controller 130 may derive a distance between the object and the vehicle 1 from the detection result, and may transmit the result derived from the speaker. Hereinafter, a method of manufacturing an antenna including a conductor whose shape and size has been designed, and/or described, will be described.

Figure 8A:
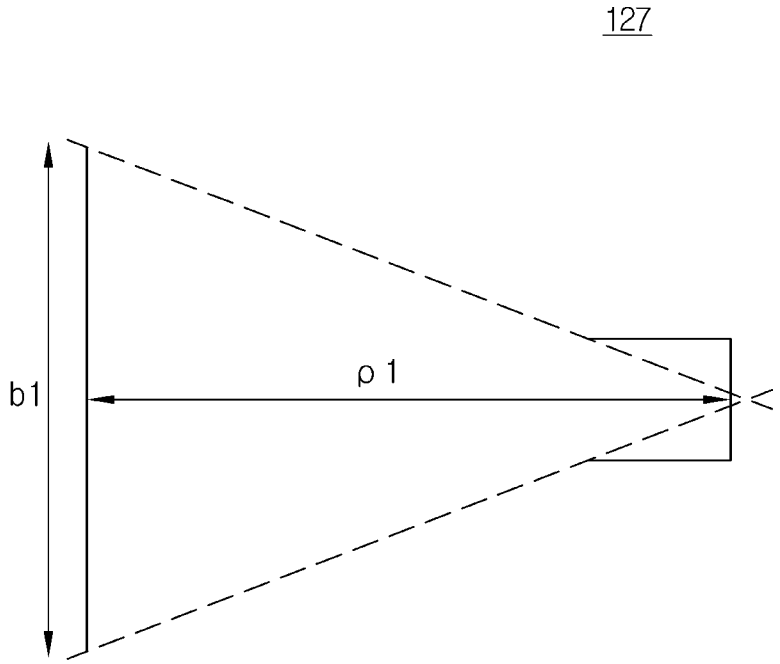
FIG. 8A is a view explaining a method of manufacturing an antenna in accordance with one embodiment of the present disclosure.
Figure 8B:
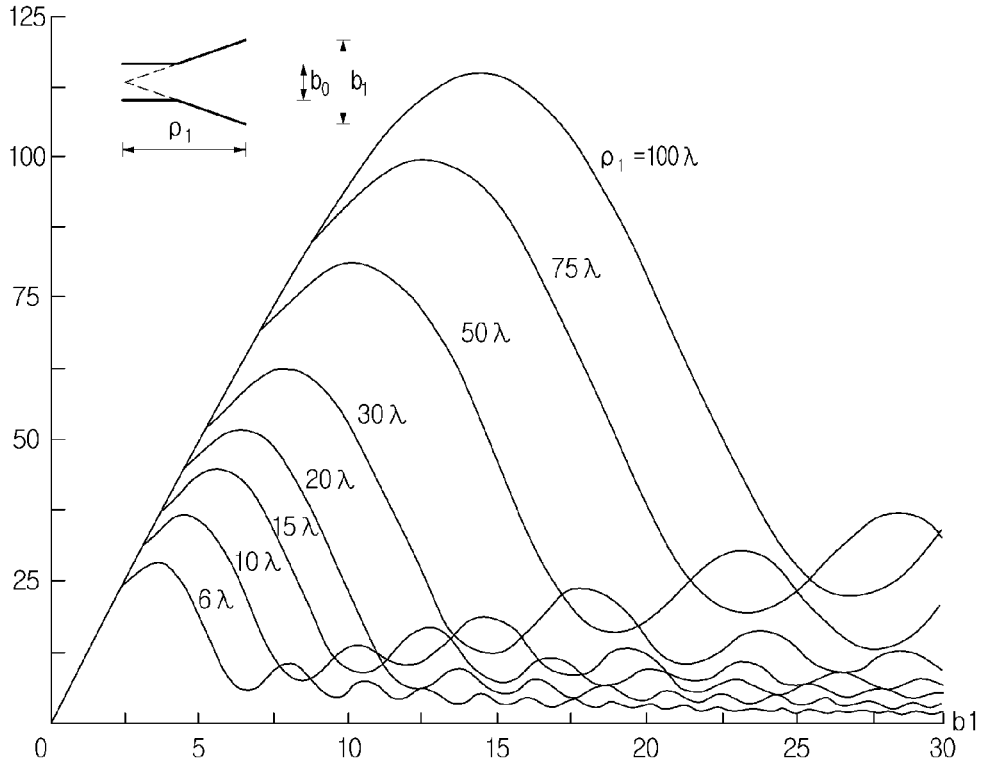
FIG. 8B shows a graph having a relationship between a height of an E-plane horn antenna and the length of the antenna in accordance with one embodiment of the present disclosure.
Figure 8C:
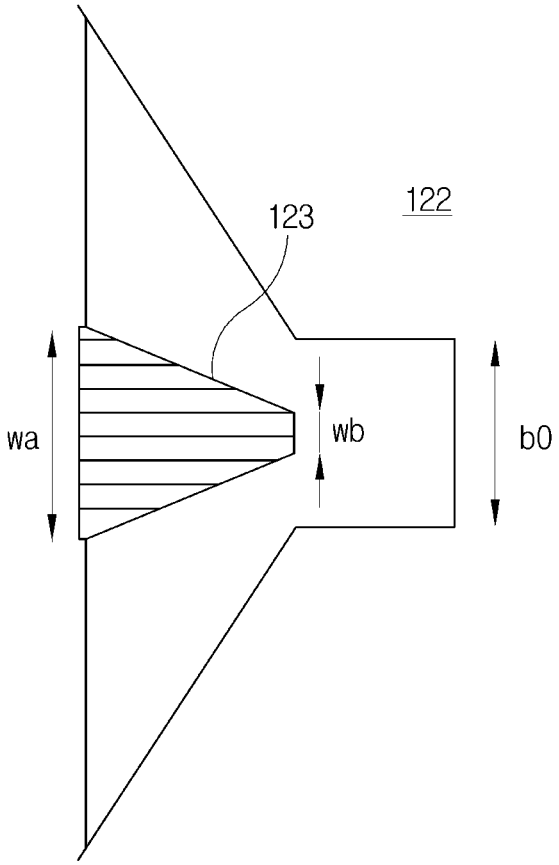
FIG. 8C is a view explaining a method of manufacturing an antenna in accordance with one embodiment of the present disclosure.
Figure 9:
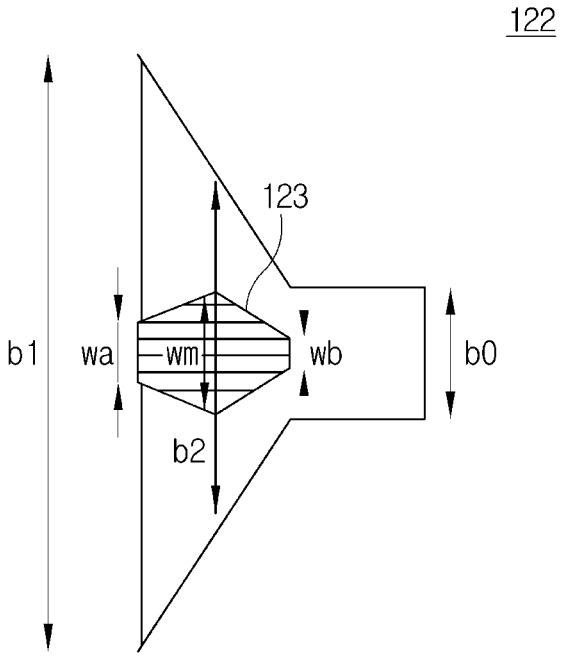
FIG. 9 is a view explaining a method of manufacturing an antenna in accordance with one embodiment of the present disclosure.

FIGS. 8A to 9 are views explaining a method of manufacturing an antenna in accordance with different embodiments of the present disclosure.

In general, a height and length of an antenna 127 having an optimal gain may be determined based on the following Equation 1.

$$b1 \approx \sqrt{2 \cdot \lambda \cdot \rho 1} \quad \text{[Equation 1]}$$

Referring to FIG. 8A, b1 denotes a height of an aperture and ρ1 denotes the length of the antenna. In addition, λ denotes a wavelength of a radio wave. Thus, when a frequency to be used in the radar device and the height of the aperture are determined, the length of the antenna 127 may be determined so as to fit the determined frequency and height. Meanwhile, a relationship between the wavelength and the frequency may be represented by the following Equation 2. Here, c denotes the speed of light and f denotes frequency. That is, the wavelength of the radio wave is inversely proportionate to the frequency.

$$\lambda = c/f \quad \text{[Equation 2]}$$

As a more specific example, FIG. 8B shows a graph having a relationship between a height of an E-plane horn antenna and the length of the antenna. Here, $D_E$ denotes a focusing degree of a radio wave, a beam, or the like radiated in a specific direction as the directivity of the E-plane horn antenna. In addition, as described above, b1 denotes the height of the aperture, ρ1 denotes the length of the antenna and b0 denotes the height of the waveguide. In this instance, the gain of the antenna may be determined by the directivity and the effect. Thus, the gain of the antenna may be proportionate to the directivity.

Meanwhile, in FIG. 8B, graphs are shown for each length of the antenna. In this instance, the relationship in the above-described Equation 1 is established from a peak value of each graph. Referring to FIG. 8B, when the length of the antenna is reduced while b1, that is an x-axis value in the peak value of each graph, is maintained, $(\lambda/a)D_E$, that is a y-axis value, is reduced. Accordingly, the directivity is reduced, such that the gain of the antenna is reduced. In this instance, since the antenna according to the embodiment has the partition wall structure by inserting the conductor, even though the length of the antenna is reduced, it is possible to achieve an increase in gain.

For example, referring to FIG. 8C, a rectangular conductor may be inserted into the antenna 122. In this instance, the phase difference between radio waves may be reduced along with an increase in a degree of inclination of the conductor 123. That is, the area in which the radio wave is able to radiate is reduced along with an increase in a difference between a first height Wa and a second height Wb of the conductor 123. Here, the first height Wa corresponds to a height of a plane in a direction in which the radio wave is radiated, that is, the height of the aperture. In addition, the second height Wb corresponds to a height of a plane in a direction in which the radio wave is input in the aperture. In this instance, the first height Wa and the second height Wb of the conductor may be determined by calculating a gain which is predicted by a simulation.

For example, based on the result obtained by the simulation, the first height Wa and the second height Wb of the rectangular conductor may be designed to satisfy (i) $0 \leq Wb \leq (b0)/2$, (ii) $0 \leq wa \leq b1/2$ and (iii) $Wb \leq Wa$. Here, b0 denotes a height of a portion in which the radio wave is input through the waveguide.

That is, the shape of the conductor 123 may be determined depending on the height b0 of the portion in which the radio wave is input through the waveguide, the height b1 of the aperture and a ratio between the height b1 of the aperture and the length ρ1 of the antenna 122. Accordingly, the vehicle according to the disclosed embodiment may detect the object present at a much farther distance through the antenna 122 in which the conductor 123 designed as described above is inserted.

Meanwhile, the shape of the conductor is not limited to the above-description, and may be designed in a variety of forms. Referring to FIG. 8B, the length and height of the antenna may be determined according to the above-described Equation 1. Accordingly, the gain of the antenna which is predicted may be calculated. In addition, the calculated gain of the antenna which is predicted may be set as a target value.

Thus, the gain of the antenna, which is predicted by reducing the length of the antenna while maintaining the height of the antenna, may be calculated through a simulation. Here, the calculated gain may be set as an initial value.

A triangular conductor may be inserted into the antenna. In this instance, a second height Wb of the triangle is 0, so that a first optimal value according to a change in a first height Wa thereof may be calculated. In this example, when the first optimal value is smaller than the above-described target value, the rectangular conductor may be inserted into the antenna, instead of the triangular conductor. Accordingly, a second optimal value according to changes in the first height Wa and the second height Wb may be calculated.

When the second optimal value is smaller than the above-described target value, a pentagonal conductor may be inserted into the antenna, instead of the rectangular conductor. That is, in order to maintain the gain although the length of the antenna is reduced, various types of conductors may be inserted into the antenna, and the gain of the antenna may be calculated while the size of the conductor is changed through a simulation.

According to one embodiment, when the gain is high based on the simulation result and any one of the first height Wa and the second height Wb is 0, the pentagonal conductor may be inserted into the antenna. Meanwhile, when an optimal value which is predicted using the pentagonal conductor is calculated and the calculated optimal value is smaller than the target value, an optimal value when a hexagonal conductor is inserted into the antenna may be calculated.

According to one embodiment, based on the simulation result, when the conductor having a hexagonal cross-section shown in FIG. 9 satisfies conditions such as (i) $0 \leq Wb \leq (b0)/2$, (ii) $0 \leq Wm \leq (b2)/2$ and (iii) $Wb \leq Wm$, (iv) $0 \leq Wa \leq Wm$, a high gain may be predicted as obtained. That is, the shape and size of the conductor inserted into the antenna may be calculated through experiments. The above-described conductor may be inserted into the antenna according to the disclosed embodiment such that the antenna has the partition wall structure, thereby maintaining the gain of the antenna while reducing the length of the antenna.

Meanwhile, when the hexagonal or pentagonal conductor is inserted into the antenna, the first height Wa may be reduced compared to when using the triangular or rectangular conductor. Accordingly, the area in which the radio wave is radiated may be increased so that the gain of the antenna may be increased.

However, when the hexagonal or pentagonal conductor is inserted, the gain of the antenna is not necessarily increased compared to when the triangular or rectangular conductor is inserted, and may vary according to a variety of variables such as the frequency to be used, the height of the antenna, the length of the antenna, and the like. According to one embodiment, when the height b1 of the antenna is less than 2λ, the effect in which the gain of the antenna is improved is large even though the triangular or rectangular conductor is used, but when the height b1 of the antenna is 2λ or larger, the effect in which the gain of the antenna is improved is large due to the pentagonal or hexagonal conductor being used, but the present disclosure is not limited thereto.

Figure 10A:
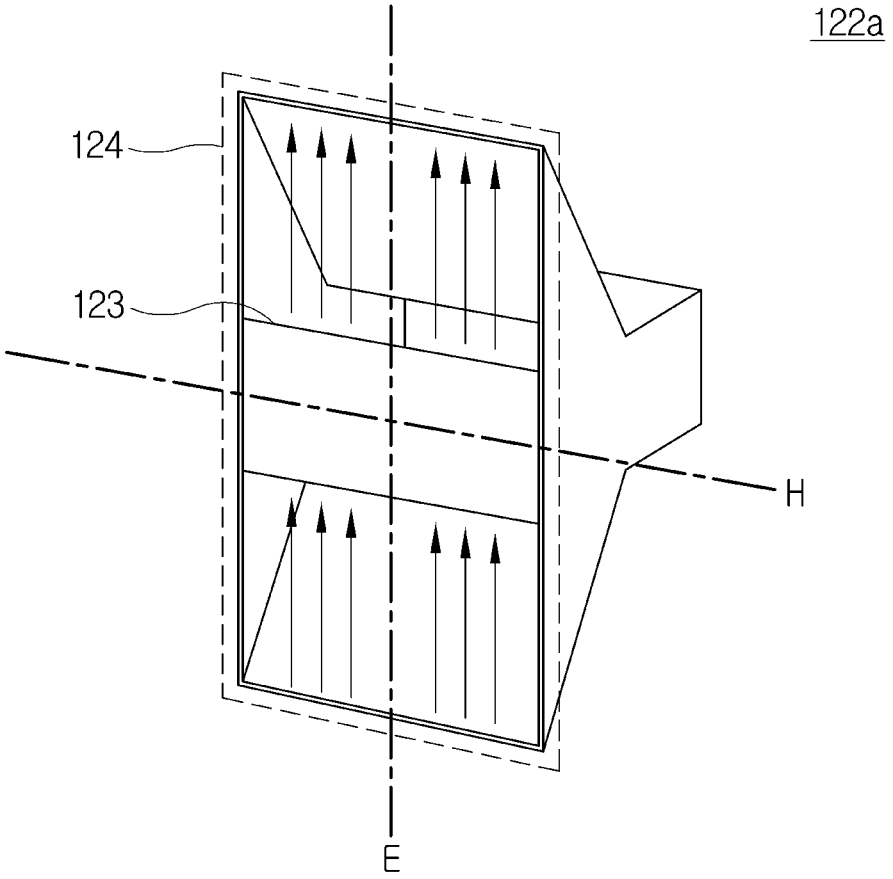
FIG. 10A is a view showing a horn antenna in which a conductor is inserted in a horizontal direction with an E-plane in accordance with one embodiment of the present disclosure.
Figure 10B:
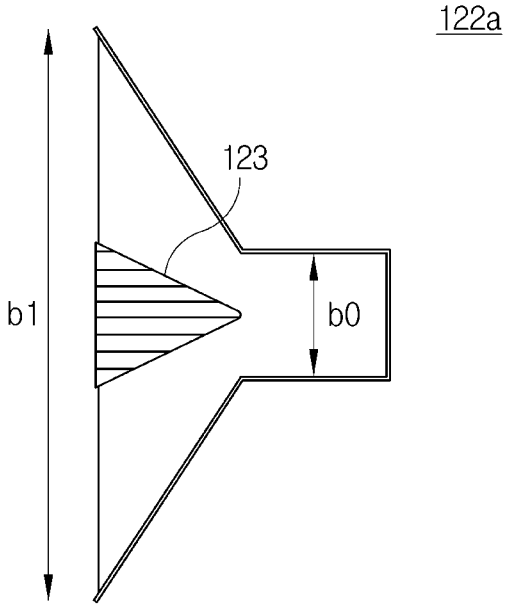
FIG. 10B is a view showing a horn antenna in which a conductor is inserted in a horizontal direction with an E-plane in accordance with one embodiment of the present disclosure.
Figure 11A:
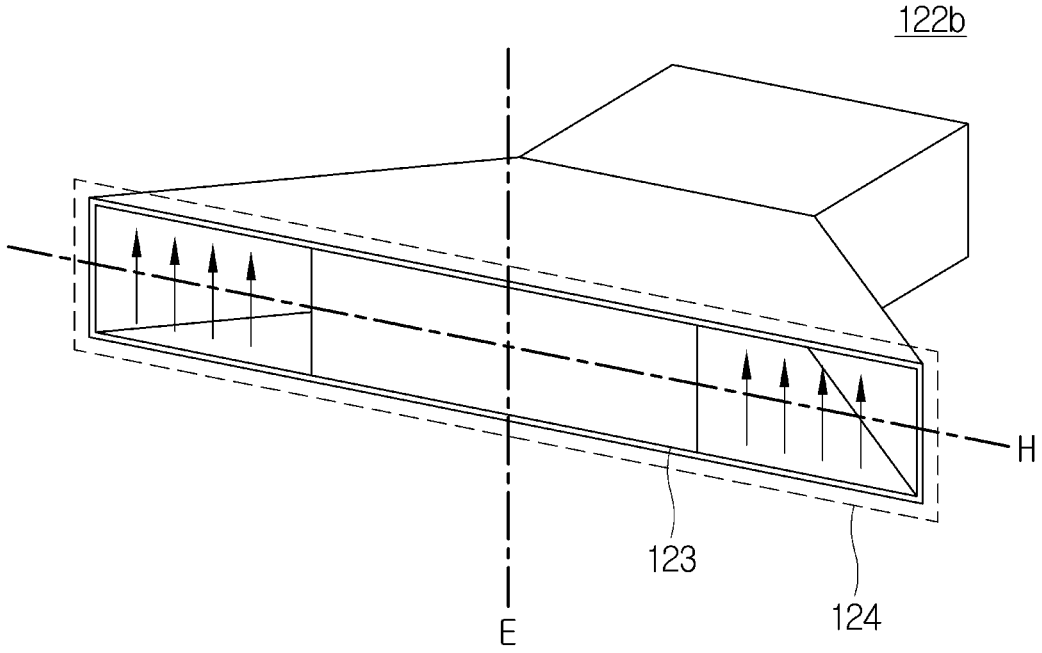
FIG. 11A is a view explaining a horn antenna in which a conductor is inserted in a horizontal direction with an H-plane and a method of manufacturing the horn antenna in accordance with one embodiment of the present disclosure.
Figure 11B:
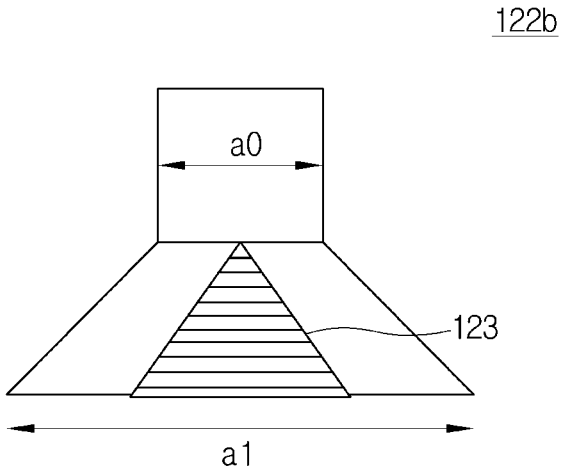
FIG. 11B is a view explaining a horn antenna in which a conductor is inserted in a horizontal direction with an H-plane and a method of manufacturing the horn antenna in accordance with one embodiment of the present disclosure.
Figure 11C:
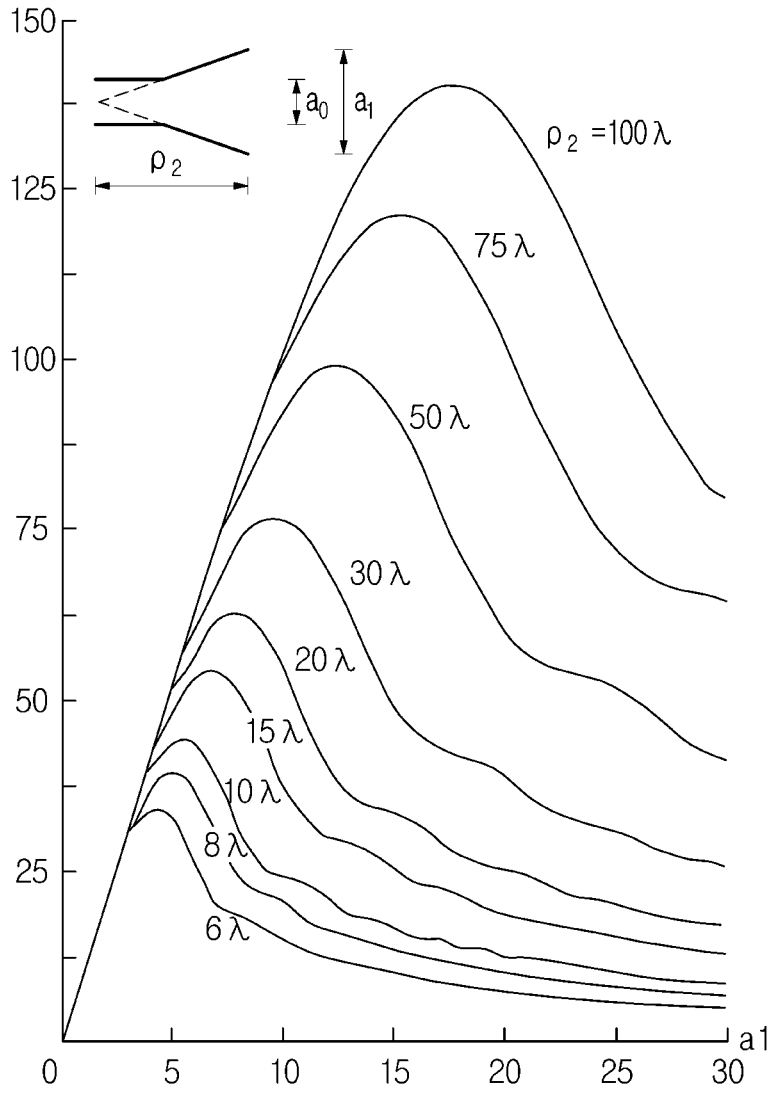
FIG. 11C shows a graph for explaining the gain of an H-plane horn antenna in accordance with one embodiment of the present disclosure.
Figure 12:
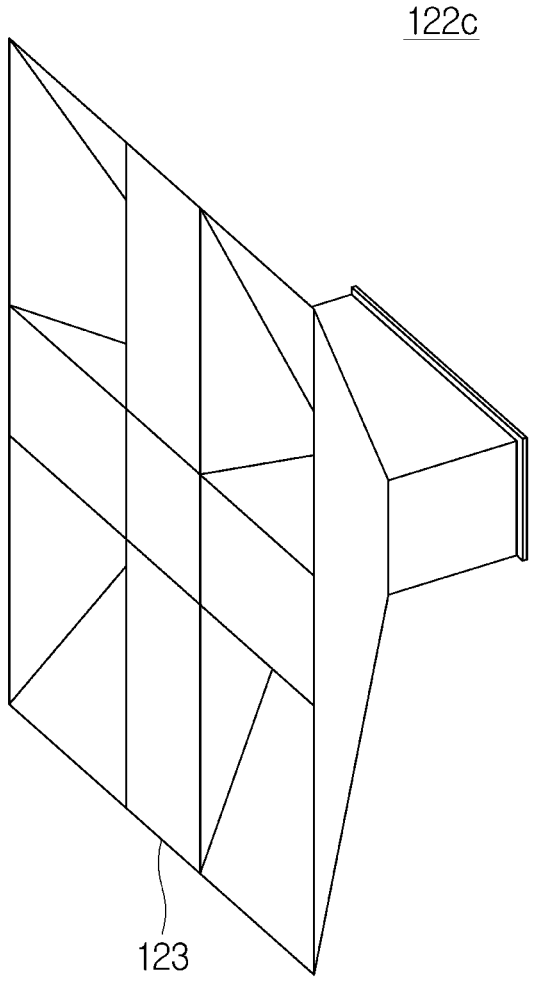
FIG. 12 shows a pyramidal horn antenna in which a conductor is inserted in a horizontal direction with an E-plane and an H-plane in accordance with one embodiment of the present disclosure.

FIGS. 10A and 10B are views showing a horn antenna in which a conductor is inserted in a horizontal direction with an E-plane in accordance with one embodiment of the present disclosure, FIGS. 11A to 11C are views explaining a horn antenna in which a conductor is inserted in a horizontal direction with an H-plane and a method of manufacturing the horn antenna in accordance with one embodiment of the present disclosure, FIG. 12 shows a pyramidal horn antenna in which a conductor is inserted in a horizontal direction with an E-plane and an H-plane in accordance with one embodiment of the present disclosure, and FIGS. 13*a*-13*c* show a circular horn antenna in which a conductor is inserted in accordance with one embodiment of the present disclosure.

The antenna may be implemented in a variety of forms depending on an opening angle, that is, the inclination of the aperture. For example, an antenna 122*a* shown in FIG. 10A is a horn antenna in which an aperture is increased in a vertical direction. Here, the antenna shown in FIG. 10A is referred to as an E-plane horn antenna. By way of another example, an antenna 122*b* shown in FIG. 11A is a horn antenna in which an aperture is increased in the horizontal direction. Here, the antenna 122*b* shown in FIG. 11*a* is referred to as an H-plane horn antenna. The E-plane refers to a plane including an electric field vector and a propagation direction of the radio wave, and the H-plane refers to a plane including a magnetic field vector and the propagation direction of the radio wave.

Referring to FIGS. 10A and 11A, an electric field vector of the shown antennas 122*a* and 122*b* is formed in the same direction as that of the E-plane. The antenna may be differently designed depending on whether a cross-section in which an opening angle is increased is a horizontal cross-section or a vertical cross-section. The conductor may be inserted into the antenna 122 according to the embodiment in the horizontal direction with the E-plane, or in the horizontal direction with the H-plane.

Referring to FIGS. 10B and 11B, the conductor 123 inserted into each of the shown antennas 122*a* and 122*b* may be implemented in such a manner that an incline may be formed in a direction in which the aperture is increased, that is, a direction in which the opening angle of each of the antennas 122*a* and 122*b* is increased. Here, b0 of FIG. 10B denotes the height of the waveguide as described above and b1 denotes the height of the aperture. In addition, a0 of FIG. 11B denotes the area of the waveguide and a1 denotes the area of the aperture.

However, when the H-plane horn antenna 122*b* is manufactured, the height and length of the antenna may be determined based on the following Equation 3.

$$a1 \cong \sqrt{3 \cdot \lambda \cdot \rho 2} \quad \text{[Equation 3]}$$

Here, a1 denotes the area of the aperture as described above, ρ2 denotes the length of the antenna and λ denotes the wavelength of the radio wave.

FIG. 11C shows a graph for explaining the gain of an H-plane horn antenna according to one embodiment of the present disclosure. Here, $D_H$ denotes a focusing degree of a radio wave, beam, or the like radiated in a specific direction as the directivity of the H-plane horn antenna. In addition, a0 denotes the area of the waveguide and a1 denotes the area of the aperture. In this instance, the gain of the antenna may be determined by the directivity and the efficiency as described above. Accordingly, the gain of the antenna may be proportionate to the directivity.

Meanwhile, in FIG. 11C, graphs are shown for multiple lengths of the antenna. In this instance, the relationship in the above-described Equation 3 is established from the peak value of each graph. Referring to FIG. 11C, when the length of the antenna is reduced while a1, that is an x-axis value in the peak value of each graph, is maintained, $(\lambda/b)D_H$, that is a y-axis value, is reduced. Therefore the gain of the antenna is reduced. In this instance, since the antenna according to the embodiment has the partition wall structure by inserting the conductor into the antenna and even though the length of the antenna is reduced, it may be possible to achieve an increase in the gain. Meanwhile, a method of determining the height and length of the antenna and the height and length of the conductor inserted into the antenna in addition to Equation 3 is the same as the above-described method, and specific description thereof will be omitted.

The antenna may be formed in a variety of forms, and the conductor inserted into the antenna is not limited to the above-described forms. For example, the antenna may be implemented in the form of a pyramid horn antenna 122*c* as shown in FIG. 12. Here, the pyramid horn antenna 122*c* refers to an antenna whose side surface is implemented in the form of a pyramid.

The conductor 123 may be inserted into the pyramid horn antenna 122*c*. In this instance, the conductor 123 may be implemented in the form of a cross when the inside of the pyramid horn antenna 122*c* is viewed from an aperture as shown in FIG. 12. That is, when viewed from an outside of the aperture towards an inside thereof, the conductor 123 may be implemented in the form of a straight line or a cross.

Figure 13:
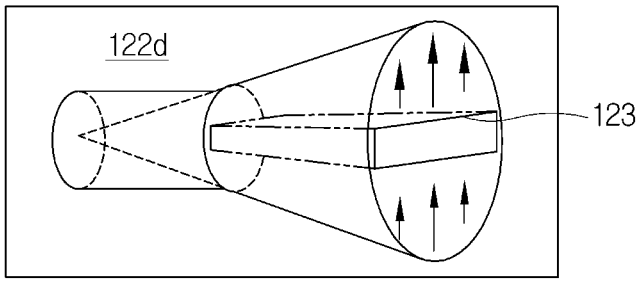
FIG. 13 shows a circular horn antenna into which a conductor is inserted in accordance with one embodiment of the present disclosure.
Figure 13:
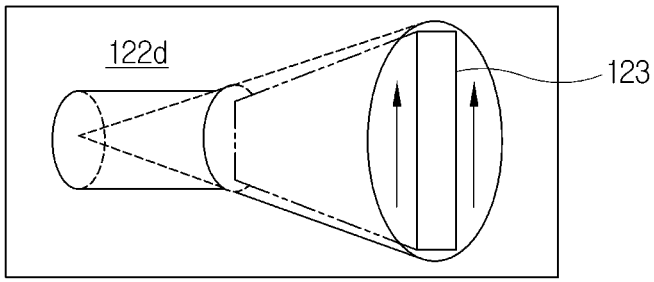
Figure 13:
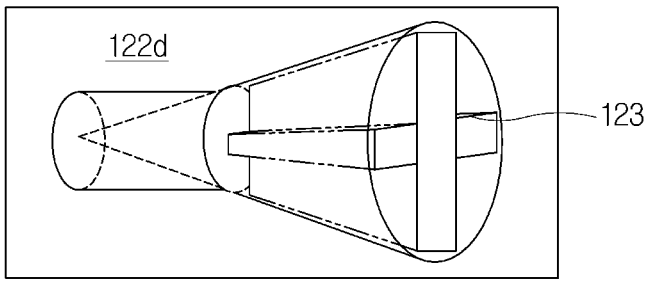

In addition, the antenna may be implemented in the form of a circular horn antenna 122*d* as shown in FIG. 13. In this instance, the conductor may be inserted into the circular horn antenna 122*d* in the horizontal direction with the E-plane which is equal to the electric field direction, as shown in FIG. 13*a*. Alternatively, the conductor may be inserted into the circular horn antenna 122*d* in the horizontal direction with the H-plane as shown in FIG. 13*b*, or inserted into the circular horn antenna 122*d* in the horizontal direction with the E-plane and the H-plane. However, this disclosure is not limited thereto.

Figure 14:
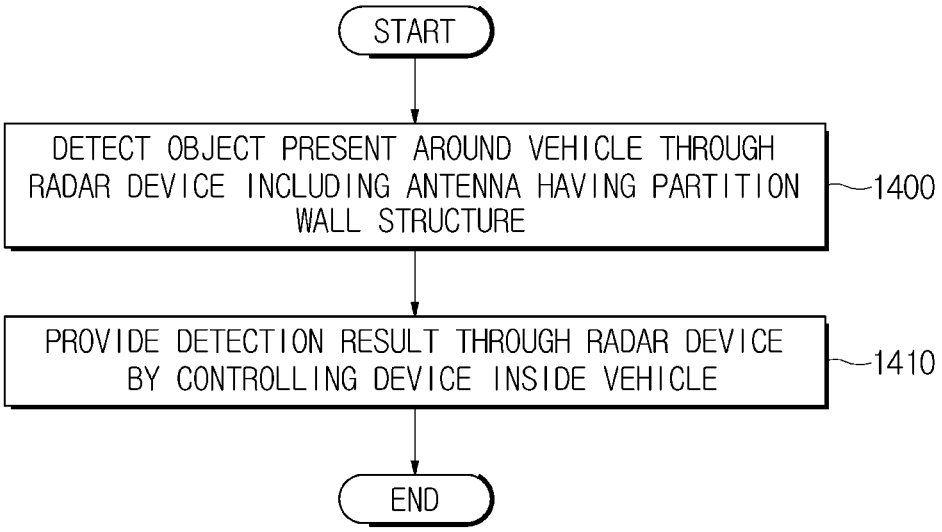
FIG. 14 is a flowchart showing operations of a vehicle detecting its surroundings through an antenna of a partition wall structure in accordance with one embodiment of the present disclosure.

FIG. 14 is a flowchart showing an operation of a vehicle detecting its surroundings through an antenna of a partition wall structure in accordance with one embodiment of the present disclosure.

In operation 1400, a vehicle may detect an object present around the vehicle using a radar device. In this instance, the vehicle may detect all objects present within a predetermined distance radius from the vehicle, and by setting a specific direction, detect an object present in the corresponding direction.

The vehicle according to an embodiment may transmit a radar signal using the antenna in which a partition wall structure is formed by inserting a polygonal conductor into the antenna, and receive the radar signal reflected from an object, thereby detecting the surroundings of the vehicle. In this instance, the vehicle may transmit radio waves to a wide area even though the length of a path in which the radio waves are radiated, that is the length of the antenna, is reduced, by inserting the conductor into the antenna.

In recent years, a variety of devices have been built into the vehicle. As the number of the built-in devices increases, the miniaturization of the devices is required, and the miniaturization thereof is also required in terms of cost savings and traveling of the vehicle. By inserting the conductor into the antenna built into the vehicle according to the embodiment, the gain of the antenna may be maintained even though the length of the antenna is reduced. Accordingly, it is possible to miniaturize the antenna, thereby reducing both the weight and volume of the antenna, and also achieving cost savings.

In addition, the gain of the antenna may be adjusted depending on the number of arranged antennas according to the embodiment. Specifically, as to the antennas according to the embodiment, one antenna is designed and then a plurality of antennas manufactured according to the same design based on the designed antenna are arranged, rather than separately designing a plurality of antennas, thus reducing design costs.

In operation 1410, the vehicle may provide the detection result through the radar device by controlling the devices inside the vehicle. For example, the vehicle may display the detection result through a display device such as a display, a cluster, or the like. By way of another example, the vehicle may display the detection result through a head-up display, and display the detection result by a variety of devices capable of displaying the detection result.

According to one embodiment, the vehicle may display the detection result in the form of a map, or display a distance between an object and the vehicle through a pop-up message by calculating the distance between the object and the vehicle from the detection result.

By way of another example, the vehicle may be connected to a user terminal through a communication network, and display the detection result through a display of the user terminal. Here, the communication network includes both a wired communication network and a wireless communication network. The wireless communication network refers to a communication network that is able to transmit and receive signals including data in a wireless manner. For example, the wireless communication network includes a Bluetooth communication network, as well as a 3G communication network and a 4G communication network, but is not limited thereto. In addition, the wired communication network refers to a communication network that is able to transmit and receive signals including data in a wired manner. For example, the wired communication network includes peripheral component Interconnect (PCI), PCI-express, universe serial bus (USB), etc., but is not limited thereto.

A communication module may be built into the user terminal so that the user terminal is able transmit and receive data to and from an external terminal through a communication network, and the user terminal includes all terminals capable of processing the transmission and reception of signals through a processor. According to one embodiment, the user terminal includes a mobile terminal such as a smart phone or a personal digital assistant (PDA), a clock removably attached to the body of a user, and a glasses type wearable terminal as well as a laptop, a desk top, and a tablet PC, but is not limited thereto.

In addition, the vehicle may calculate the distance between the object and the vehicle from the detection result, and when a collision with the object on the path on which the vehicle is currently running is predicted, the vehicle may calculate the predicted collision and transmit the calculated collision using the speaker so that it is possible to notify the user of the predicted danger.

The method according to the embodiment may be implemented as an application or implemented in the form of program instructions that may be executed in various computer components and recorded on a computer-readable recording medium. The computer-readable recording medium may include program instructions, data files, data structures, and the like individually or in a combination. The program instructions recorded on the medium may be specifically designed and constructed for the present disclosure, and may be made publicly available to and useable by those having ordinary skill in the art of the computer software. Examples of the computer-readable recording medium include a magnetic medium such as a hard disk, a floppy disk, or a magnetic tape, an optical recording medium such as a compact disc-read only memory (CD-ROM) or a digital video disc (DVD), a magneto-optical medium such as a floptical disk, and a hardware device such as a read only memory (ROM), a random access memory (RAM), or a flash memory that is specially designed to store and execute program instructions.

Examples of the program instructions include not only machine code generated by a compiler or the like, but also high-level language codes that may be executed by a computer using an interpreter or the like. The hardware device described above may be constructed so as to operate as one or more software modules for performing the operations of the embodiments of the present disclosure, and vice versa.

While the disclosure has been shown and described with reference to certain exemplary embodiments thereof, it will be understood by those skilled in the art that various changes in form and details may be made therein without departing from the spirit and scope of the disclosure as defined by the appended claims.

What is claimed is:

1. An antenna comprising:

an opening through which a radio wave is radiated in an orientation direction; and a conductor inserted into the opening and dividing an internal region of the opening and an aperture, wherein a first height of a plane of the conductor in a direction in which the radio wave is input to the opening is smaller than a second height of a plane of the conductor in a direction in which the radio wave is radiated, and wherein the second height is smaller than a height of the aperture, and the first height is smaller than a height of a waveguide.

2. The antenna according to claim 1, wherein the conductor has a polygon shape and divides the aperture through which the radio wave is radiated in the opening.

3. The antenna according to claim 1, wherein the conductor has a straight line or cross shape when an inside of the antenna is viewed with respect to the opening.

4. The antenna according to claim 1, wherein a type of the conductor is determined based on a wavelength of the radiated radio wave.

5. A vehicle comprising:

a radar device that detects an object present around the vehicle using an antenna which has a partition wall structure by a polygonal conductor inserted into the antenna, the polygonal conductor dividing an aperture through which the radio wave is radiated in an opening; and a controller that provides a detection result using the radar device by controlling a device inside the vehicle, wherein a first height of a plane of the polygonal conductor in a direction in which a radio wave is input to the opening of the antenna is smaller than a second height of a plane of the polygonal conductor in a direction in which the radio wave is radiated, and wherein the second height is smaller than a height of the aperture, and the first height is smaller than a height of a waveguide.

6. The vehicle according to claim 5, wherein the antenna has a straight line or cross shape when an inside of the antenna is viewed with respect to the opening.

7. The vehicle according to claim 5, wherein a type of the conductor is determined based on a wavelength of the radio wave radiated through the antenna while the conductor is inserted into the antenna.

8. The vehicle according to claim 5, wherein the controller displays the detection result from the radar device using at least one of a display or a cluster, or transmits the detection result from the radar device using a speaker.

9. A method of manufacturing an antenna, comprising steps of:

calculating a gain of the antenna according to a length and a height of the antenna;

determining a shape and a size of a conductor by comparing the calculated gain of the antenna and a gain of the antenna which is predicted when the conductor for dividing an aperture of an opening of the antenna is inserted; and manufacturing the antenna by inserting the conductor generated based on the determined shape and size of the conductor into the antenna.

10. The method according to claim 9, wherein the step of determining includes determining the size of the conductor in such a manner that a height of a plane in a direction in which a radio wave is input to the opening and a height of a plane in a direction in which the radio wave is radiated are different from each other.

11. The method according to claim 9, wherein the step of determining includes determining the size of the conductor in such a manner that a height of a plane in a direction in which the radio wave is input to the opening is smaller than a height of a plane in a direction in which the radio wave is radiated.

12. The method according to claim 9, wherein the step of determining includes determining the shape of the conductor in the form of a straight line or a cross when an inside of the antenna is viewed with respect to the opening.

13. The method according to claim 9, wherein the step of manufacturing includes inserting the conductor to be parallel to at least one of an E-plane parallel to a direction of an electric field vector or an H-plane parallel to a direction of a magnetic field vector.

* * * * *